US008005191B2

(12) United States Patent
Jaafar et al.

(10) Patent No.: US 8,005,191 B2
(45) Date of Patent: Aug. 23, 2011

(54) FIELD EMISSION X-RAY APPARATUS, METHODS, AND SYSTEMS

(75) Inventors: Ali Jaafar, Eden Prairie, MN (US); Victor I. Chornenky, Minnetonka, MN (US)

(73) Assignee: Minnesota Medical Physics LLC, Edina, MN (US)

( * ) Notice: Subject to any disclaimer, the term of this patent is extended or adjusted under 35 U.S.C. 154(b) by 3 days.

(21) Appl. No.: 12/356,182

(22) Filed: Jan. 20, 2009

(65) Prior Publication Data

US 2010/0002841 A1 Jan. 7, 2010

Related U.S. Application Data

(60) Provisional application No. 61/133,582, filed on Jul. 1, 2008.

(51) Int. Cl.
*H01J 35/00* (2006.01)

(52) U.S. Cl. ..... 378/122; 378/65

(58) Field of Classification Search ..... 378/65, 378/119, 122
See application file for complete search history.

(56) References Cited

U.S. PATENT DOCUMENTS

| | | | | |
|---|---|---|---|---|
| 3,303,372 | A | 2/1967 | Gager | |
| 5,153,900 | A | 10/1992 | Nomikos et al. | |
| 5,165,093 | A | 11/1992 | Miller et al. | |
| 5,428,658 | A * | 6/1995 | Oettinger et al. | 378/119 |
| RE35,383 | E | 11/1996 | Miller et al. | |
| 5,729,583 | A | 3/1998 | Tang et al. | |
| 5,854,822 | A | 12/1998 | Chornenky et al. | |
| 6,055,294 | A | 4/2000 | Foerst et al. | |
| 6,108,402 | A | 8/2000 | Chornenky | |
| 6,134,300 | A | 10/2000 | Trebes et al. | |
| 6,148,061 | A | 11/2000 | Shefer et al. | |
| 6,289,079 | B1 | 9/2001 | Chornenky et al. | |
| 6,319,188 | B1 | 11/2001 | Lovoi | |
| 6,324,257 | B1 | 11/2001 | Halavee | |
| 6,353,658 | B1 | 3/2002 | Trebes et al. | |
| 6,381,305 | B1 | 4/2002 | Okada et al. | |
| 6,415,016 | B1 | 7/2002 | Chornenky et al. | |
| 6,438,206 | B1 * | 8/2002 | Shinar et al. | 378/119 |
| 6,480,568 | B1 | 11/2002 | Dinsmore | |
| 6,514,192 | B2 | 2/2003 | Tiren | |
| 6,546,077 | B2 | 4/2003 | Chornenky et al. | |
| 6,580,940 | B2 | 6/2003 | Gutman | |
| 6,623,418 | B2 | 9/2003 | Smith | |
| 6,661,875 | B2 | 12/2003 | Greenwald et al. | |

(Continued)

OTHER PUBLICATIONS

Christophe Valmaggia et al., Abstract for "Age-related macular degeneration: long-term results of radiotherapy for subfoveal neovascular membranes", PubMed for Am J Ophthalmol., vol. 130, Issue 5, Nov. 2000, 1 page.

(Continued)

*Primary Examiner* — Chih-Cheng G Kao
(74) *Attorney, Agent, or Firm* — Skaar Ulbrich Macari, P.A.

(57) ABSTRACT

There is disclosed herein a field emission x-ray apparatus comprising: a housing including proximal and distal housing ends; a probe including proximal and distal probe ends, wherein the proximal probe end is attach to the distal housing end and the distal probe end is sealingly closed by a cathode, and wherein the apparatus further includes an anode having proximal and distal anode ends with the distal anode end being separated from the cathode by a gap and the proximal anode end being attached to a heat sink; wherein said the further includes an outer probe surface and wherein the outer probe surface comprises a conductive probe surface coating.

11 Claims, 6 Drawing Sheets

U.S. PATENT DOCUMENTS

| | | | | |
|---|---|---|---|---|
| 6,771,737 | B2 | 8/2004 | Kerslick et al. | |
| 6,799,075 | B1 * | 9/2004 | Chornenky et al. | 378/65 |
| 6,987,835 | B2 | 1/2006 | Lovoi | |
| 7,158,612 | B2 | 1/2007 | Rusch et al. | |
| 7,338,487 | B2 | 3/2008 | Chornenky et al. | |
| 7,466,799 | B2 | 12/2008 | Miller | |
| 7,771,117 | B2 | 8/2010 | Kim et al. | |
| 2002/0090053 | A1 * | 7/2002 | Chornenky et al. | 378/119 |
| 2003/0179854 | A1 * | 9/2003 | Jaafar | 378/119 |
| 2003/0210765 | A1 * | 11/2003 | Greenwald et al. | 378/119 |
| 2005/0232392 | A1 * | 10/2005 | Bradley et al. | 378/45 |
| 2010/0002840 | A1 | 1/2010 | Jaafar et al. | |

OTHER PUBLICATIONS

H. Kobayashi et al., Abstract for "Radiotherapy for subfoveal choroidal neovascularization in age-related macular degeneration: a randomized clinical trial", American Journal of Ophthalmology, vol. 133, Issue 4, Apr. 2002, 1 page.

A.S. Baturin et al., "Electron gun with field emission cathode of carbon fiber bundle", J. Vac. Sci. Technol. B 21(1), Jan./Feb. 2003, Feb. 3, 2003, American Vacuum Society, 4 pages.

A.S. Baturin et al., "Lifetime and emission stability of carbon fiber cathodes", Materials Science and Engineering A353 (2003), 2003, Elsevier Science B.V., 5 pages.

* cited by examiner

10

FIELD EMISSION X-RAY APPARATUS, METHODS, AND SYSTEMS

CLAIM OF PRIORITY UNDER 35 U.S.C. §119

The present Application for Patent claims priority to Provisional Patent Application No. 61/133,582 entitled "X-ray Apparatus for Electronic Brachytherapy" filed Jul. 1, 2008, and assigned to the assignee hereof and hereby expressly incorporated by reference herein.

BACKGROUND

1. Field

The presently disclosed embodiments relate generally to apparatus, methods and systems for generating x-rays using field emission technologies and the use thereof, principally in the area of brachytherapy.

2. Technical Background

Since the discovery of x-rays by William Roentgen in 1895, practically all man-made x-ray generators have been built around the same basic design. This design comprises a tube housing two spatially separated electrodes (an anode and a cathode), a high voltage generator supplying voltage between the electrodes to create an accelerating electric field therebetween, and a means to create an electron beam directed from the cathode to the anode. In operation, electrons leave the cathode, are accelerated by the electric field, and impinge on the anode. As the electrons decelerate at the anode surface their kinetic energy in part is released in the form of an emission of x-rays.

A principle difference in the various such man-made x-ray generators is in the method of creating the electron beam. Basically, these methods include the use of a thermionic cathode to generate the electron beam or the use of an electron field emission effect. Each of these methods of x-ray production relies upon different technologies and different physical processes. Consequently, each method requires different hardware in implementing a particular method of x-ray production and use, with one methodology not necessarily being able to use the hardware of the other methodology.

X-rays produced with a thermionic cathode utilize a cathode heated to a temperature sufficient to cause electrons to "boil" off the cathode. The electrons are then pulled by an applied electric field to an anode. Upon striking the anode, a small portion of the electrons' kinetic energy is converted into x-rays, with the remainder being converted to heat. For this reason, most such x-ray devices utilize a rotating anode so that the heat is evenly spread over the anode.

As noted, x-rays can also be produced using field emission technology. Apparatus producing x-rays by field emission include a cathode and an anode held in a vacuum and the application of a high voltage electric field between them. The electric field pulls electrons from the cathode and accelerates them toward the anode with a kinetic energy dependent upon the electric field strength. Upon striking the anode, the electrons release some of their kinetic energy in the form of x-rays. The larger the operating voltage between the anode and cathode, the greater the energy that the produced x-rays will have.

The use of x-rays for therapeutic uses has been widely adopted. These therapeutic uses include, but are not limited to radiation therapy as a treatment for various forms of cancer. In addition, radiation therapy has been proposed for a form of a progressively degenerative eye disease known as macular degeneration.

OVERVIEW

There is disclosed herein a field emission x-ray apparatus comprising: a housing including proximal and distal housing ends; a probe including proximal and distal probe ends, wherein the proximal probe end is attached to the distal housing end and the distal probe end is sealingly closed by a cathode, and wherein the apparatus further includes an anode having proximal and distal anode ends with the distal anode end being separated from the cathode by a gap and the proximal anode end being attached to a heat sink; wherein said the further includes an outer probe surface and wherein the outer probe surface comprises a conductive probe surface coating.

There is also disclosed herein a method for providing radiation therapy for macular degeneration comprising: providing x-ray field emission apparatus comprising providing a housing including proximal and distal housing ends; a probe including proximal and distal probe ends wherein the proximal probe end is attached to the distal housing end and wherein the probe further includes a cathode attached to the distal probe end; and wherein the field emission apparatus further comprises an anode including proximal and distal anode ends, with the anode being disposed at least partly within the probe of the x-ray field emission apparatus and with the distal anode end separated from the cathode by a vacuum gap; gaining access with the probe to the interior of an eye with macular degeneration; disposing the probe distal end at a predetermined position relative to the macular degeneration; providing a predetermined radiation therapy to the eye; and cooling the x-ray field emission apparatus by providing a heat sink attached to the proximal anode end.

DETAILED DESCRIPTION

Figure 1:
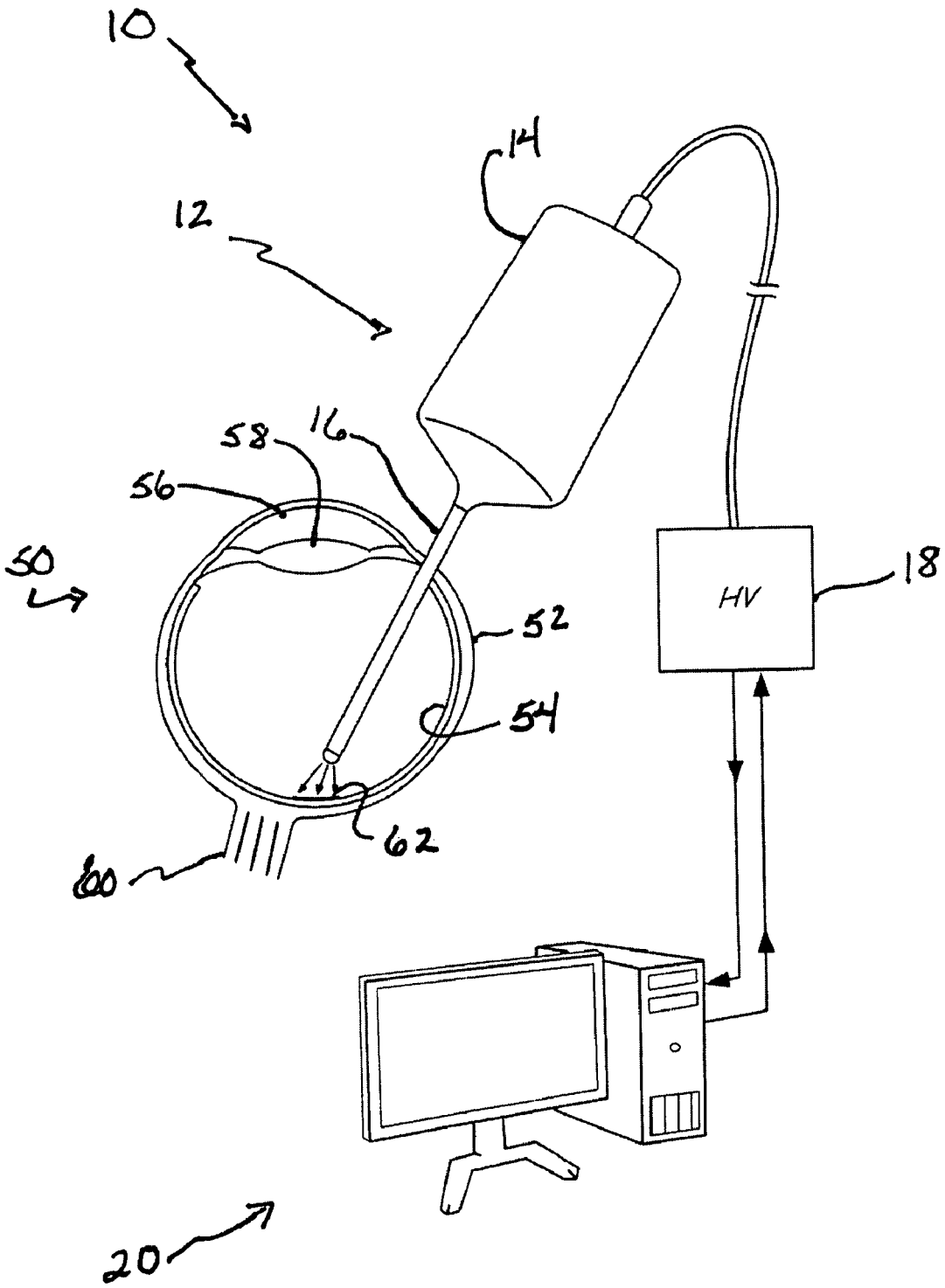
FIG. 1 illustrates a system for generating x-rays using field emission technologies wherein the methods and apparatus described further herein may find application.

Referring now to FIG. 1, an x-ray system 10 for generating x-rays using field emission technology is schematically illustrated. System 10 comprises an x-ray apparatus 12 including a housing 14 and a probe 16. The apparatus 12 is electrically connected to a high voltage generator 18. Activation of generator 18 creates a stream of electrons that passes from a cathode to an anode within the probe 16. When the electrons subsequently impact upon the anode, x-rays are generated.

The system 10 further includes a computer system 20, which is in communication with the high voltage generator. The computer 20 can monitor the voltage and current supplied by the generator 20 and supply real-time analysis of the operation of the apparatus 12, including real-time calculations of the intensity of the x-rays generated. As discussed further below, in a clinical setting where the apparatus is being used for therapeutic purposes, the intensity of radiation applied to the patient can be precisely calculated. The computer system 20 can also be used to precisely control a regimen by enabling an operator to control the intensity of x-rays generated, the time period during which they are generated and the direction of the x-ray output from the apparatus 12. In addition, the computer system 20 can also be used, if desired, to monitor or control one or more ( in addition to any other parameter desired to be measured and/or controlled) of following: temperature; coolant flow and coolant temperature where a cooling system is used in conjunction with the apparatus 12; and the position and orientation of the apparatus 12 relative to a radiation target of interest, etc.

It will be understood that the x-ray apparatus 12 is schematically represented in FIG. 1. Both housing 14 and probe 16 can take on a variety of dimensions depending upon the particular application. For therapeutic uses in a clinical setting it is anticipated that the cross sectional area of the probe 16 will be substantially less than that of the housing 14. It will be understood, then, that as shown herein, the probe 16 is shown enlarged relative to the housing 14 for purposes of clearly illustrating the various parts thereof. Additionally, both the housing 14 and probe 16 can take on a variety of shapes depending upon a particular application. For example, housing 14 is shown as having a cylindrical configuration, though such a shape is neither required nor critical to the operation of the present invention. In many applications of an apparatus 12 it will be held within an appropriate mechanical support frame (not shown) of types well known in the art to allow translation and rotation of the apparatus 12, thereby enabling relatively precise positioning relative to a target of interest for application of x-rays generated by the apparatus 12. In such circumstances, other shapes—such as square, pentagonal, hexagonal, etc., may be more appropriate for use in conjunction with the support frame to reduce the likelihood of slippage between the housing and the frame.

Thus, certain uses may require or make desirable both housing 14 and probe 16 of different lengths, different cross-sectional configurations, and different cross-sectional areas than the cylindrical cross-sections illustrated and described herein, and all such configurations are within the scope of the embodiments disclosed.

In some embodiments, housing 14 and probe 16 can enclose communicating vacuum spaces. In other embodiments, it may be desirable only to make the probe 16 or parts thereof enclose a vacuum, though other aspects of the probe and housing may require reconfiguration of the constituent components enclosed therein and more complex sealing arrangements as a result.

Figure 2:
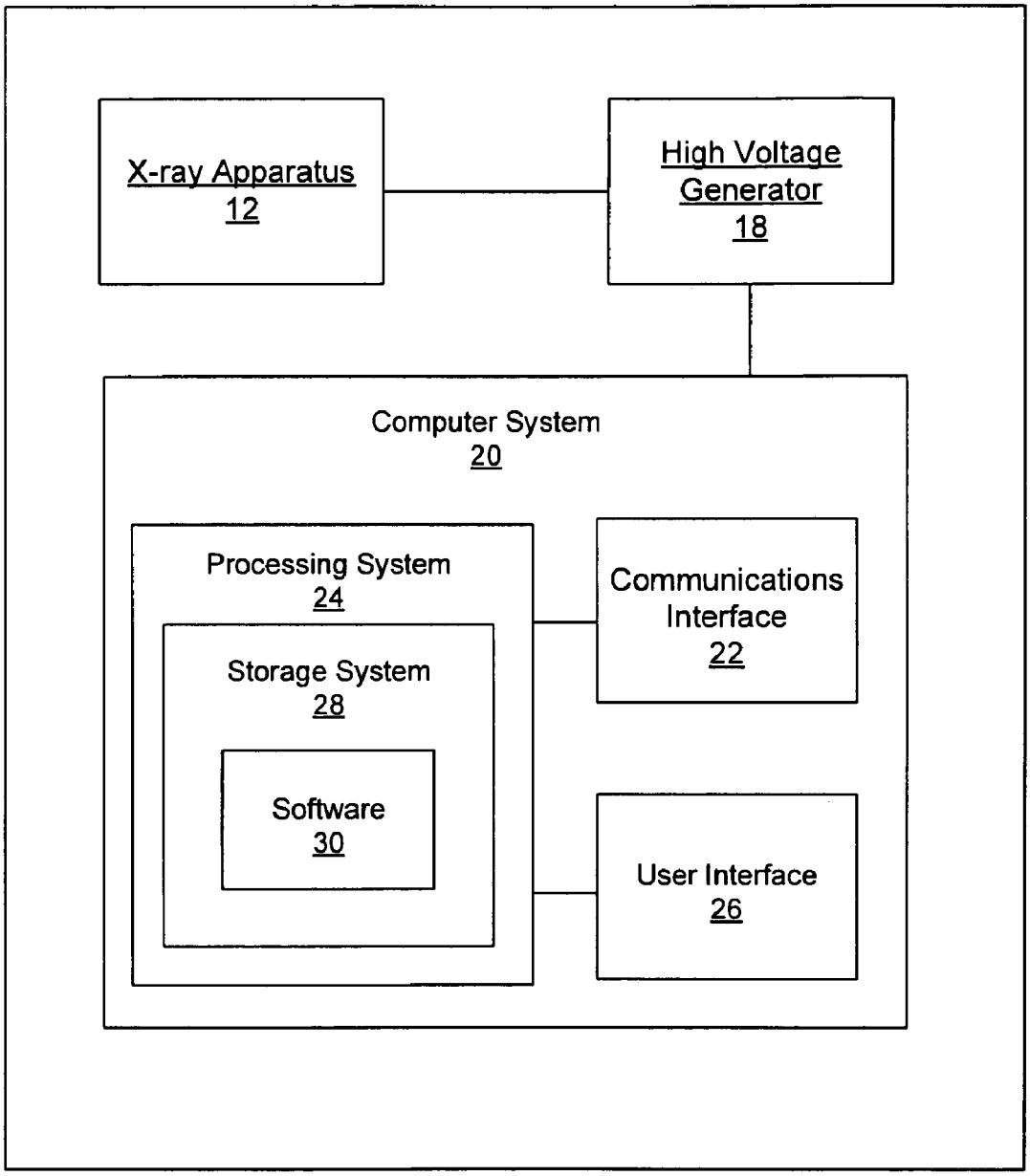
FIG. 2 illustrates in a block diagram form a system for generating x-rays using field emission techniques wherein the methods and apparatus described further herein may find application.

FIG. 2 illustrates a block diagram of a field emission x-ray system 10 in accord with which the various embodiments disclosed herein may find application. System 10 includes an x-ray apparatus 12, a high voltage generator 18, and a computer system 20.

Computer system 20 includes communication interface 22, processing system 24, and user interface 26. Processing system 24 includes storage system 28. Storage system 28 stores software 30. Processing system 24 is linked to communication interface 22 and user interface 26. Computer system 20 could be comprised of a programmed general-purpose computer, although those skilled in the art will appreciate that programmable or special purpose circuitry and equipment may be used. Computer system 20 may be distributed among multiple devices that together comprise elements 22-30.

Communication interface 22 could comprise a network interface, modem, port, transceiver, or some other communication device, thereby enabling remote operation of the system 10 if desired. Communication interface 22 may be distributed among multiple communication devices. Processing system 24 could comprise a computer microprocessor, logic circuit, or some other processing device. Processing system 24 may be distributed among multiple processing devices. User interface 26 could comprise a keyboard, mouse, voice recognition interface, microphone and speakers, graphical display, touch screen, or some other type of user device. User interface 26 may be distributed among multiple user devices. Storage system 28 could comprise a disk, tape, integrated circuit, server, or some other memory device. Storage system 28 may be distributed among multiple memory devices.

Processing system 24 retrieves and executes software 30 from storage system 28 for the operation of x-ray system 10. Software 30 may comprise an operating system, utilities, drivers, networking software, and other software typically loaded onto a computer system. Software 30 could comprise an application program, firmware, or some other form of machine-readable processing instructions. When executed by processing system 24, software 30 directs processing system 24 to operate as described herein.

The methods disclosed herein may be implemented as firmware in processing system 24 or software or a combination of both.

Figure 3:
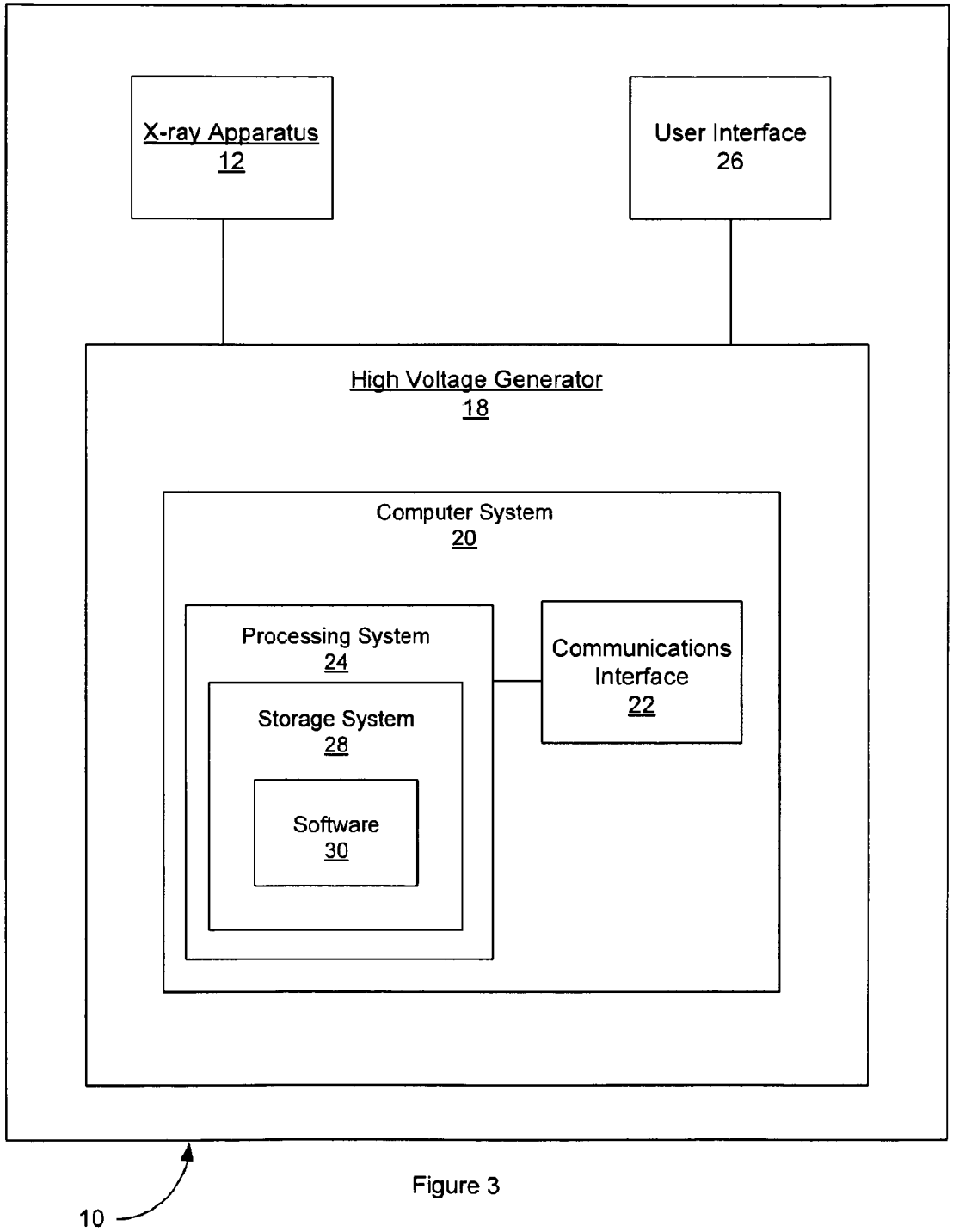
FIG. 3 illustrates in a block diagram form a system for generating x-rays using field emission techniques wherein the methods and apparatus described further herein may find application.

FIG. 3 illustrates an alternative version of system 10 wherein the high voltage generator 18 includes the computer system 20. In either embodiment shown in FIGS. 2 and 3, the high voltage generator will include the necessary microcircuitry, electronics and software/firmware to control as precisely as desired the generation of a high voltage and its provisioning to the x-ray apparatus 12.

The computer system 20 is provided, as noted earlier, as a means for inputting desired dosage levels and dwell times (the length of time that the apparatus is maintained at a particular position relative to a target of interest), amongst other functionalities disclosed herein. Application of radiation therapy to a predetermined volume of tissue may be made with the apparatus, systems, and methods disclosed herein and the positioning and dwell times of the apparatus 12 relative to that predetermined volume may be controlled by the computer system 20.

Referring briefly to FIG. 1, it will be observed that the x-ray apparatus 12 is shown being used relative to an eye 50. Eye 50 includes the outer containing layer 52 known as the sclera. The retina 54 is a layer of light-receptive cells known as rods and cones (not shown) that lies against the inside surface of the sclera 52. Light enters the eye 50 and transits the cornea 56 and the lens 58 on its way to the retina 54 where it is sensed by the retina and which subsequently sends the appropriate signals to the brain via the optic nerve 60. A small area of the retina 54 is known as the macula 62.

The macula lies near the center of the retina of a human eye and is the eye's most sensitive area. Near the macula's center is the fovea. The fovea is a small depression that contains the largest concentration of cone cells in the eye and is responsible for central vision. In contrast to the rest of the retina, which receives its blood supply from the retinal artery, the macula receives its blood supply from the choroid, which is a layer of blood vessels between the retina and sclera (not shown for purposes of simplicity).

Because the macula is so important to central vision, damage to it will normally become immediately obvious. Some individuals experience a continuous deterioration of the macula known as macular degeneration. In cases of macular degeneration, abnormal blood vessels grow into the space between the retina and choroid and cause damage to the eye structure. More specifically, the exuberant proliferation of new capillaries in the space between the retina and the choroid leads to the detachment of the retina, and finally, blindness. Radiation treatment of the macula has been shown to reduce the proliferation of the capillaries and preserve some measure of the patient's vision.

Figure 4:
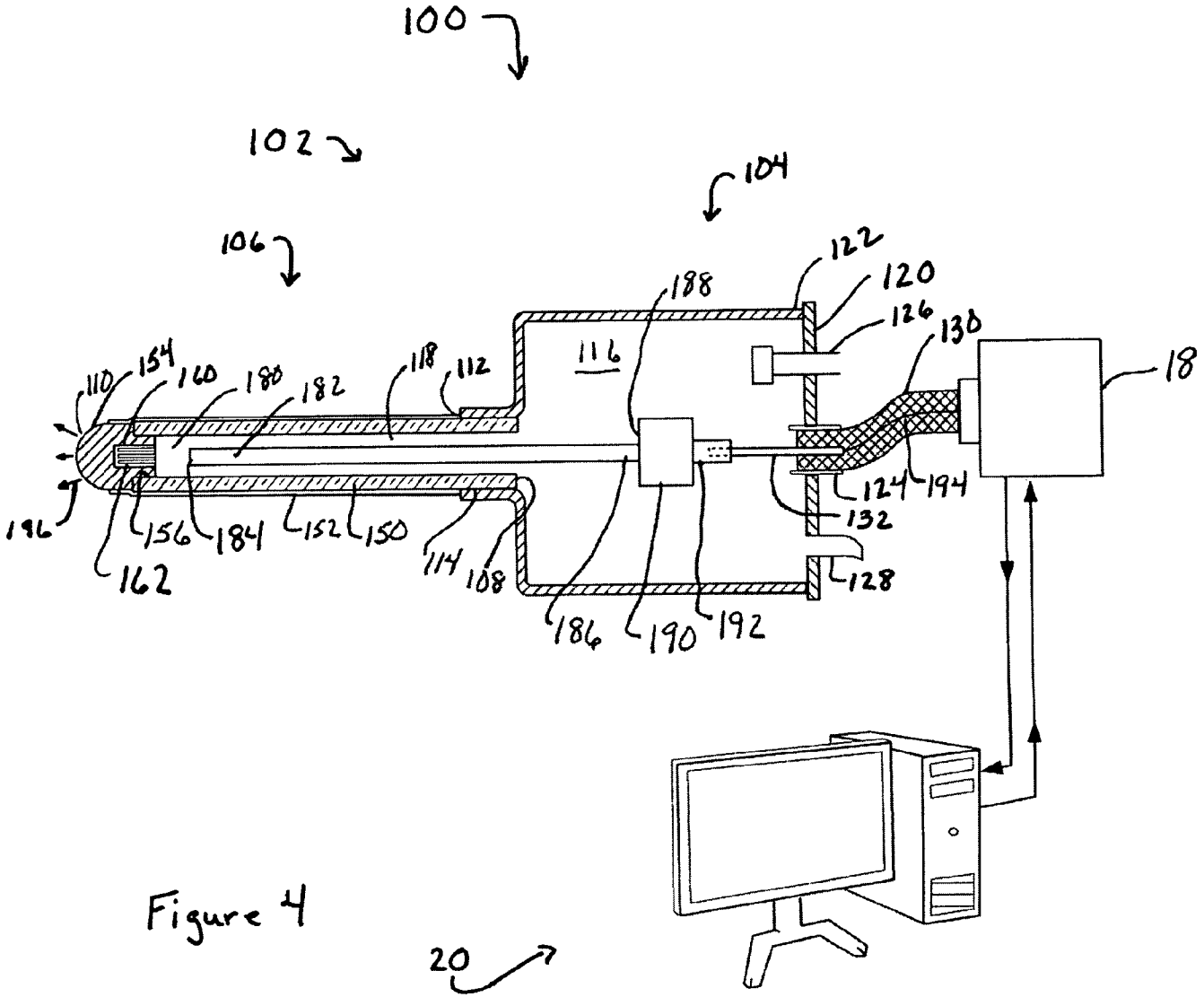
FIG. 4 illustrates an embodiment of an x-ray field emission apparatus in accord with the disclosures herein.

FIG. 4 illustrates an embodiment of system 100 for brachytherapy particularly suitable for ophthalmologic applications such as for the radiation treatment of macular degeneration. System 100 includes an x-ray apparatus 102, a high voltage generator 18 and a computer system 20 operationally connected to the high voltage generator 18. Generator 18 and system 20 may take the form of either of the embodiments shown in FIGS. 2-3, or may take any other form consistent with the disclosure herein and the described operation of the x-ray apparatus 102.

Apparatus 102 comprises a housing 104 and a probe 106 having a proximal probe end 108 and a distal probe end 110. Housing 104 and probe 106 may be joined in any known manner consistent with the uses and operation described herein. As shown in the Figure, the proximal probe end 108 is received within an appropriately sized and configured aperture 112 and sealingly attached thereto at a vacuum tight joint 114, which makes the hollow interior 116 of the housing 104 and the hollow interior 118 of the probe 106 a single vacuum chamber when appropriately evacuated of atmosphere.

An end cap 120 is sealing attached to the proximal end 122 of the housing 104 in any known manner sufficient for the uses and applications described herein and so as to maintain the vacuum in the interiors 116 and 118, respectively, of housing 104 and probe 106. End cap 120 includes an electrical feedthrough 124, which provides a high voltage electrical connection from the high voltage generator 18 to components to be hereafter described in the interior of the housing 104. End cap 120 also supports a getter 126, which is used to maintain a high vacuum in the apparatus 102 after manufacture, and a pinch-off tube 128, which is used for pumping out the housing 104 during manufacture. The feedthrough 124 is connected to the positive pole of the high voltage power supply 18 via a coaxial cable 130. The high voltage is delivered into the vacuum chamber by the electrical connector 132 of feedthrough 124. For safety reasons the housing 104 and the probe 106 are grounded (not shown for purposes of clarity).

The elongated probe 106 of the apparatus 100 comprises a thin quartz tube 150 covered with an electrically conductive coating 152. It will be understood that the conductive coating is shown exaggerated in size relative to the probe 106 for purposes of clarity. Operationally the conductive coating can be applied to the tube in as thin a layer as desired consistent with the uses described herein. Coating 152 serves at least two functions. First, coating 152 provides an electrical connection between the housing 104 and a cathode cap 154, which seals the probe 106 at its distal end 110 by a vacuum tight joint 156. Second, the coating 152 is provided to absorb x-rays emitted from the sides of probe 106, and thus must be made of a material that is opaque to x-rays.

The cathode 154, however, is made of conductive materials that are transparent to x-rays, such as but not limited to graphite or beryllium. The cathode 154 includes an axial hole 160 configured to receive a field emission element 162. The field emission element 162 also illustrated in FIG. 5.

The field emission element provides the source of an electron beam that travels in a proximal direction therefrom. Field emission element 162 may be advantageously configured to have a substantially cylindrical shape, though the present embodiment is not so limited and other shapes and configurations may find use in the present embodiments. Field emission element 162 is made of a solid cylindrical body made of a composite material comprising carbon fibers 164 embedded in a binder 166, such as a conductive ceramic or conductive glass.

Figure 5:
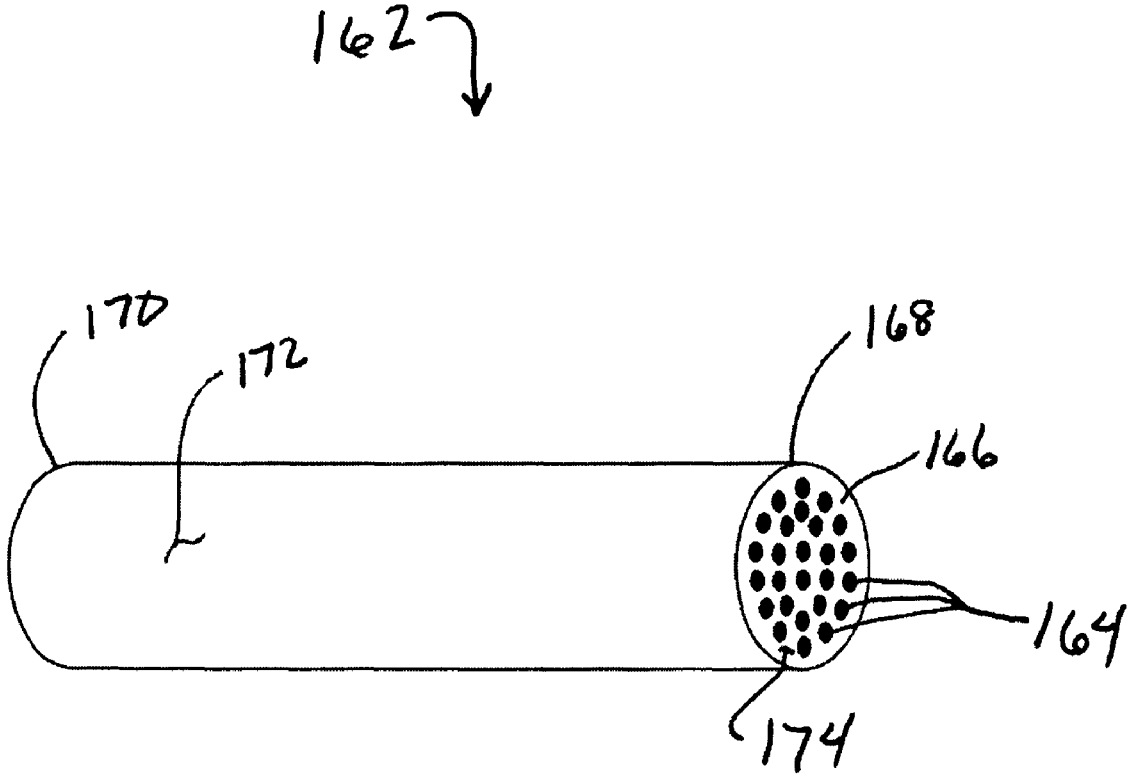
FIG. 5 illustrates a field emission element in accord with the disclosures herein.

Stated in greater detail, the field emission element 162 includes a proximal, operating end 168 and a distal end 170, which together with the side 172 of the field emission element 162 are secured in the axially extending cavity or hole 160 in the proximal end of the cathode 154 with a conductive adhesive, such as a conductive ceramic adhesive. The electron beam emitting tips of the fibers are best seen in FIG. 5. Preferably, the operating or electron beam emitting surface 174 of the field emission element 162 will be mirror polished to reduce or eliminate any significant protrusions on its surface. The polished surface provides a minimum of distortions of the electric field and the emitting pattern.

In one embodiment of field emission element 162 the carbon fibers are continuous and constitute a laminated structure stretched along the element 162. In another embodiment the carbon fibers 164 are short in comparison with the length of the field emission element 162.

A field emission element 162 can be manufactured by mixing the fibers by any known method with a conductive ceramic adhesive or matrix material in a proportion in the range of 60% to 90% to the matrix material by weight and extruded into cylindrically shaped rods. Subsequently, the rods are fired in an oven at a temperature appropriate for the particular adhesive matrix being used. The rods are then cut to size and polished at the operating end. A plurality of fiber ends, regardless of their length, at the operating surface 174 of the rod provides field emission of electrons normally to the surface when an adequate electric field is applied.

In an alternative manufacturing method, the mixture of the conductive ceramic adhesive and carbon fibers may be placed into molds rather than extruded, and fired thereafter As noted, the field emission element comprises a composite material secured inside the hole 160 by a conductive ceramic adhesive, with its proximally directed electron beam emitting surface 174 disposed across a vacuum gap 180 from an anode 182. The anode 182 of the x-ray apparatus is formed as a rod-like structure with distal and proximal anode ends 184 and 186, respectively. The anode may be made of tungsten, copper or metallized CVD diamond. The proximal anode end 186 is attached to the distal end 188 of a heat sink element 190 by any known and acceptable methods such as brazing. The heat sink is made of a relatively massive piece of metal or metal alloy with a significant heat capacity, such as, but not limited to, copper. In particular, it is desirable that the heat sink be relatively massive relative to the anode, since the anode will be generating the heat during operation that needs to be absorbed to avoid overheating of the apparatus. The material forming heat sink 190 should have a heat capacity of about at least 20 Joules per degree Kelvin. The mass of the heat sink is determined by the applied power and duration of the treatment. In the case of a typical ophthalmology procedure such as that described hereafter, a 50 gram heat sink would be of adequate size to safely absorb the generated heat and operate the apparatus safely.

The proximal end 192 of the heat sink is electrically connected to the central pin 194 of the feedthrough 130 via electrical connector 132. In this embodiment the x-ray apparatus is intended to deliver a therapeutic radiation dose in a short time frame, thus obviating the need for a cooling system. During operation of the apparatus 100 the heat generated at the tip of the anode accumulates in the heat sink apparatus.

During operation the computer 20 collects information on the progress of the accumulation of the treatment dose and turns off the apparatus when the treatment is complete. When the high voltage is applied between the cathode 154 and the anode 182 the field emission element 162 starts emitting electrons into the vacuum gap 180 in the direction of the distal end 184 of the anode 182. The electrons impinge on the anode and generate x-ray radiation propagating predominantly in the forward distal direction. This is illustrated by the arrows 196 of FIG. 4 depicting radial distribution of x-ray intensity. The intensity distribution will not be entirely uniform radially because of a somewhat higher absorption of the x-rays by the field emission element than by the graphite or beryllium cathode cap 154. This feature allows the therapist to achieve a flat distribution of the dose across the intended treatment target.

In this embodiment of the apparatus the operating current I during operation is kept predominantly constant and the current fluctuations and drifts are compensated by appropriate changes in the operating voltage.

In a preferred embodiment the operating voltage is stable and the current is allowed to fluctuate somewhat. In some applications it may be desired to stabilize the operating current I by changing the operating voltage. In this case the dose delivered to the treatment target may be calculated as described below.

The radiation dose rate DR delivered to a reference point in the radiation field created by the apparatus 12 generally is defined by the formula:

$$DR=K(V)\times I, \tag{1}$$

where

I is the operating current; and

K(V) is a coefficient of proportionality.

The value of K(V) depends on the operating voltage V and the distance and angular position of the point in the radiation field relative to the x-ray source. Usually, a reference point is selected on the treatment target to control the delivery of the dose. The radiation dose D(t) that is delivered to the reference point from the start of treatment to a present time depends only on the voltage and is an integral of the dose rate over time:

$$D(t)=\int \mathrm{DR}\times dt=\int K(V)\times I\times dt \tag{2}$$

If a sampling time in the computer is selected to be Δt and the value of I is a known constant, then the accumulated dose D(t) at the reference point can be computed as follows:

$$D(t)=I\times\Delta t\times\Sigma K(V). \tag{3}$$

Figure 6:
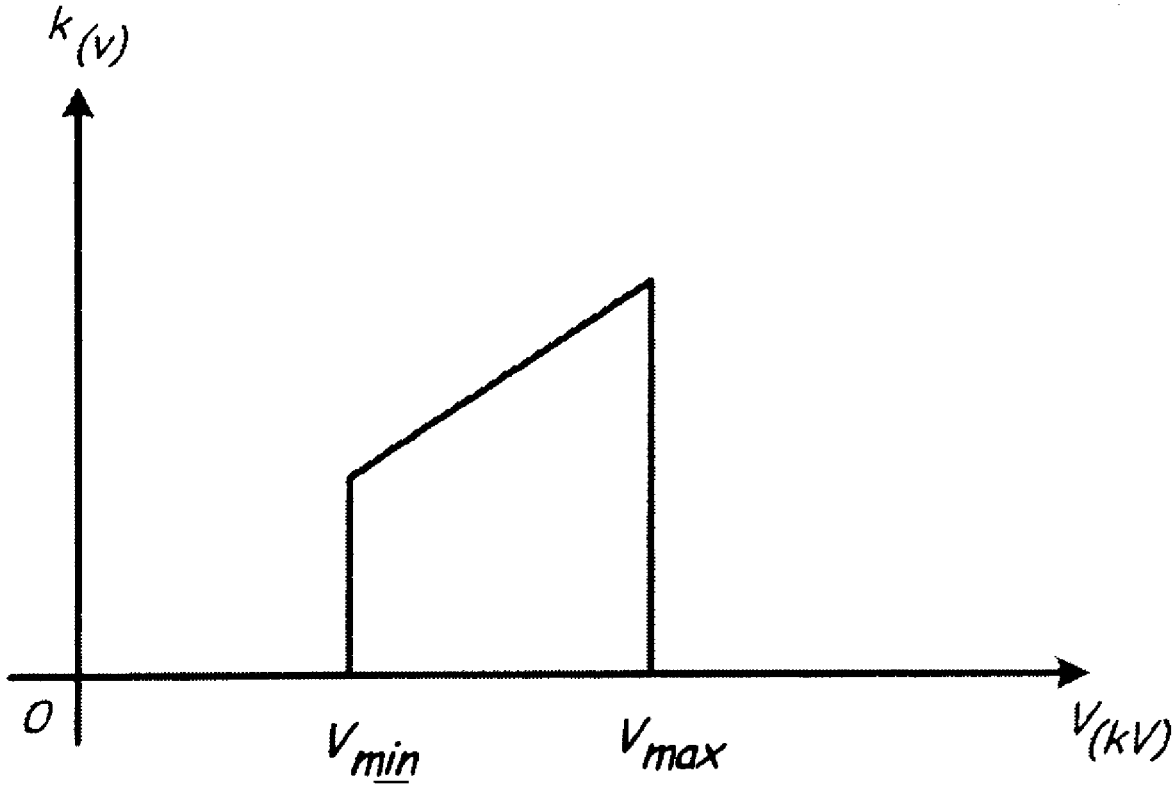
FIG. 6 illustrates a graph illustrating the relationship between the voltage provided to the x-ray apparatus by the high voltage generator and the coefficient of proportionality K(V) as described herein.

Here ΣK(V) is the total sum of all coefficients K(V) computed for each sampling time. Every sampling of information about the operating voltage V is delivered to the computer, such as computer 20, which in turn computes the value of K(V) and the sum ΣK(V). The function K(V) is a tabulated function measured during tests of the x-ray system and stored in the computer memory. This function is very close to a linear dependence and is shown in FIG. 6. During treatment the computer 20 continuously computes the accumulated dose D(t) and when the dose reaches a designated value, the computer system 20 can be programmed to stop treatment and turn off the x-ray system.

It should be mentioned that what is shown in this embodiment is intended for ophthalmologic applications where the x-ray apparatus does not employ a linear actuator for stabilization of the operating current. In another variation of the embodiment the linear actuator can be used. In this case both the operating voltage and current are known constants and the dose can be easily computed as a product of the coefficient K, current I and total time of the irradiation.

Referring to FIG. 1, again, the ophthalmologic application of the x-ray apparatus disclosed herein for the treatment of macular degeneration is illustrated. In a procedure using the apparatus disclosed herein, access to the interior of the eye is gained through techniques known in the art. The elongated probe 16 of the x-ray apparatus is introduced into the interior of the eye and its distal end 110 is positioned at a predetermined distance from the macula 62. During such a procedure the x ray apparatus will preferably be held or supported by a frame or mechanical delivery system (not shown in the Figure for purposes of clarity). The x-ray apparatus is powered by a high voltage power supply 18 and controlled by a computer 20. Following delivery of the treatment dose, the x-ray apparatus is turned off, the probe 16 is removed from the eye and the incision is sutured.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. For example, but limited to, method steps can be interchanged without departing from the scope of the invention. As a result, the invention is not limited to the specific embodiments described above, but only by the following claims and their equivalents.

The invention claimed is:

1. A method for providing radiation therapy for macular degeneration comprising:

providing x-ray field emission apparatus comprising:

a housing including proximal and distal housing ends;

a probe including proximal and distal probe ends; said proximal probe end attached to said distal housing end, wherein said probe further includes a cathode attached to said distal probe end, the cathode including proximal and distal cathode ends and an axially extending hole in said proximal cathode end; and wherein said field emission apparatus further comprises an anode including proximal and distal anode ends, said anode disposed at least partly within said probe of said x-ray field emission apparatus, said distal anode end separated from said cathode by a vacuum gap;

disposing a field emission element comprising carbon fibers in a conductive binder within said axially extending hole;

gaining access with said probe to the interior of an eye with macular degeneration;

disposing said probe distal end at a predetermined position relative to the macular degeneration;

providing a predetermined radiation therapy to the eye; and cooling said x-ray field emission apparatus by providing a heat sink attached to said proximal anode end.

2. The method of claim 1 wherein said field emission element includes an operating surface disposed to face said anode distal end across said vacuum gap, said operating surface producing an electron stream directed toward said anode when operating.

3. The method of claim 1 wherein said heat sink is relatively massive compared to said anode.

4. The method of claim 1 wherein said probe comprises a quartz tube including an outer probe surface and wherein said cathode is electrically connected to said housing by a conductive coating disposed on said outer probe surface extending between said housing and said cathode.

5. An x-ray field emission apparatus comprising:

a housing including proximal and distal housing ends;

a probe including proximal and distal probe ends, the proximal probe end attached to the distal housing end;

a cathode attached to the distal probe end, the cathode including proximal and distal cathode ends and an axially extending hole in the proximal cathode end;

a field emission element comprising carbon fibers in a conductive binder within said axially extending hole; and an anode including proximal and distal anode ends, the anode disposed at least partly within the probe, the distal anode end separated from said cathode by a vacuum gap.

6. The apparatus of claim 5, wherein the probe comprises a tube comprising an insulating material, the probe having an outer probe surface, and wherein the cathode is electrically connected to the housing by a conductive coating disposed on the outer probe surface and the conductive coating extends between the housing and the cathode.

7. The apparatus of claim 5, further comprising a heat sink in thermal communication with the anode.

8. The apparatus of claim 7, wherein the heat sink is sized to safely absorb the heat generated during a radiation therapy procedure for macular degeneration.

9. The apparatus of claim 7, wherein the heat sink is configured to maintain the apparatus at a safe temperature without the need for a cooling system.

10. The apparatus of claim 5, wherein the cathode and anode are arranged such that when a high voltage is applied between the cathode and the anode, the field emission element emits electrons into the vacuum gap in the direction of the distal end of the anode.

11. The apparatus of claim 5, further comprising a high voltage generator in electrical communication with the cathode and a computer system in operative communication with the high voltage generator.

* * * * *